US007716839B2

(12) United States Patent
Onion et al.

(10) Patent No.: US 7,716,839 B2
(45) Date of Patent: May 18, 2010

(54) FOLDING KNIFE WITH REMOVABLE BLADE

(75) Inventors: Kenneth J. Onion, Kaneohe, HI (US); Craig Green, Sherwood, OR (US)

(73) Assignee: KAI U.S.A., Ltd., Tualatin, OR (US)

( * ) Notice: Subject to any disclaimer, the term of this patent is extended or adjusted under 35 U.S.C. 154(b) by 52 days.

(21) Appl. No.: 11/195,330

(22) Filed: Aug. 1, 2005

(65) Prior Publication Data

US 2006/0070243 A1 Apr. 6, 2006

Related U.S. Application Data

(63) Continuation-in-part of application No. 10/631,920, filed on Jul. 30, 2003.

(60) Provisional application No. 60/399,772, filed on Jul. 30, 2002.

(51) Int. Cl.
*B26B 1/02* (2006.01)

(52) U.S. Cl. ..... 30/157; 30/156; 30/331

(58) Field of Classification Search ..... 30/155, 30/156, 157, 158, 159, 160, 161, 329, 330, 30/331, 333, 339, 153
See application file for complete search history.

(56) References Cited

U.S. PATENT DOCUMENTS 298,115 A * 5/1884 Peace ..... 30/517
397,949 A * 2/1889 Walb ..... 30/157
576,648 A * 2/1897 Autenrieth ..... 30/151
1,049,931 A * 1/1913 Smith ..... 30/157
1,087,342 A * 2/1914 Yerzley ..... 30/157
1,358,097 A * 11/1920 Neft ..... 30/153
1,428,296 A * 9/1922 Neft ..... 30/153
1,706,251 A 3/1929 Perry
2,265,775 A 12/1941 McNamara ..... 30/157
3,660,895 A * 5/1972 West ..... 30/162
3,829,967 A 8/1974 Gilbert ..... 30/157
3,851,986 A 12/1974 Daughtry ..... 403/373
3,896,546 A 7/1975 Hildebrandt ..... 30/157
4,408,394 A 10/1983 Phelps ..... 30/157
4,439,922 A 4/1984 Sassano
4,442,600 A 4/1984 Felix-Dalichow ..... 30/161
4,730,393 A * 3/1988 Coburn ..... 30/153
4,918,820 A 4/1990 Korb et al. ..... 30/161
5,546,662 A 8/1996 Seber et al. ..... 30/161
5,797,188 A 8/1998 Gilbert ..... 30/330

(Continued)

FOREIGN PATENT DOCUMENTS

FR 2705606 A1 12/1994

(Continued)

*Primary Examiner*—Hwei-Siu C Payer
(74) *Attorney, Agent, or Firm*—Seed IP Law Group PLLC

(57) ABSTRACT

A knife is provided including a first side and a second side where the first side may be removably coupled to the second side. The knife further includes a blade removably secured to the handle and rotatable about a pivot point between an open position and a closed position. A manually-releasable fastening device disposed on the handle is adapted to secure the first side to the second side and to secure the blade to the handle, while remaining attached to the handle.

13 Claims, 4 Drawing Sheets

U.S. PATENT DOCUMENTS

| | | | | | |
|---|---|---|---|---|---|
| 5,802,722 | A | | 9/1998 | Maxey et al. | |
| 5,815,927 | A | | 10/1998 | Collins | 30/161 |
| 5,819,414 | A | | 10/1998 | Marifone | 30/160 |
| 5,937,527 | A | * | 8/1999 | Okada | 30/332 |
| 5,979,065 | A | | 11/1999 | Hsu | 30/519 |
| 6,026,575 | A | | 2/2000 | Wonderley | 30/125 |
| 6,101,723 | A | | 8/2000 | Ford | 30/157 |
| 6,134,788 | A | | 10/2000 | Chen et al. | 30/125 |
| 6,145,202 | A | | 11/2000 | Onion | |
| 6,154,965 | A | | 12/2000 | Sakai | 30/161 |
| 6,345,202 | B2 | | 2/2002 | Richmond et al. | 607/42 |
| 6,354,007 | B1 | | 3/2002 | Scarla | 30/156 |
| 7,370,421 | B2 | * | 5/2008 | Onion et al. | 30/157 |
| 2002/0066187 | A1 | * | 6/2002 | Jennings | 30/161 |
| 2004/0139613 | A1 | * | 7/2004 | Onion et al. | 30/161 |

FOREIGN PATENT DOCUMENTS

| | | |
|---|---|---|
| JP | 5-185381 | 7/1993 |
| JP | 9-277202 | 10/1997 |

* cited by examiner

FOLDING KNIFE WITH REMOVABLE BLADE

CROSS-REFERENCE TO RELATED APPLICATIONS

This application is a continuation-in-part of U.S. patent application Ser. No. 10/631,920, filed Jul. 30, 2003, now U.S. Pat. No. 7,370,421 which claims the benefit under 35 U.S.C. §119(e) of U.S. Provisional Patent Application No. 60/399,772 filed Jul. 30, 2002, where these applications are incorporated herein by reference in their entireties.

BACKGROUND OF THE INVENTION

Field of the Invention

The present invention relates generally to folding knives, and more specifically, to a folding knife with a removable blade. Folding knives are disclosed in a number of U.S. patents, including U.S. Pat. Nos. 6,145,202, 5,802,722, and 5,815,927, the disclosures of which are hereby incorporated by reference. Knives with removable blades are shown in U.S. Pat. Nos. 1,706,251, 2,265,775, 3,851,986, 3,896,546, 4,408,394, 4,918,820, 5,979,065, 6,134,788, and 6,354,007, the disclosures of which are incorporated herein by reference for all.

BRIEF SUMMARY OF THE INVENTION

According to an embodiment of the invention, a folding knife is provided, including a handle having first and second side pieces coupled in a spaced-apart relationship and rotatable, relative to each other, around a first pivot axis between an open and a closed position; a blade coupled to the handle and configured to rotate around a second pivot axis, relative to the handle, between an extended and a folded position, and configured to be removable from the handle while the first and second side pieces are rotated away from the closed position; and a fastener coupled to the second side piece and configured to rotationally lock the first and second side pieces in the closed position, and further configured to release the first side piece for rotation away from the closed position, with the fastener remaining coupled to the second side piece.

The fastener comprises a post coupled to the second side piece and having a pivot neck of a first diameter and a pivot collar of a second diameter, greater than the first diameter. The blade includes a pivot aperture having a diameter greater than the second diameter and a slot extending from the pivot aperture to an edge of the blade, the slot having a width greater than the first diameter but less than the second diameter, such that the blade can receive the pivot collar in the pivot aperture without permitting the post to slide through the slot. If the blade is moved such that the pivot neck is within the pivot aperture, the blade can be removed from the handle by sliding the post through the slot.

While the first and second side pieces are in the closed position the blade is held such that a portion of the pivot collar is within the pivot aperture. While the first and second side pieces are rotated away from the closed position, the blade is translatable to a position in which only the pivot neck is within the pivot aperture, such that the blade can be removed from the handle.

The first side piece includes a handle slot extending from the second pivot axis to an edge of the first side piece, a seat centered on the second pivot axis and recessed to a first depth, and a channel centered over the slot and extending from the seat to the edge of the side piece, the slot being recessed to a second depth less than the first depth. The knob is configured to move between an engaged position, wherein the knob bears against the seat, and a disengaged position, where the knob at least clears the channel such that the second side piece can be rotated away from the closed position, the post passing through the handle slot, thus allowing removal of the blade as previously described.

DETAILED DESCRIPTION OF THE INVENTION

Figure 1:
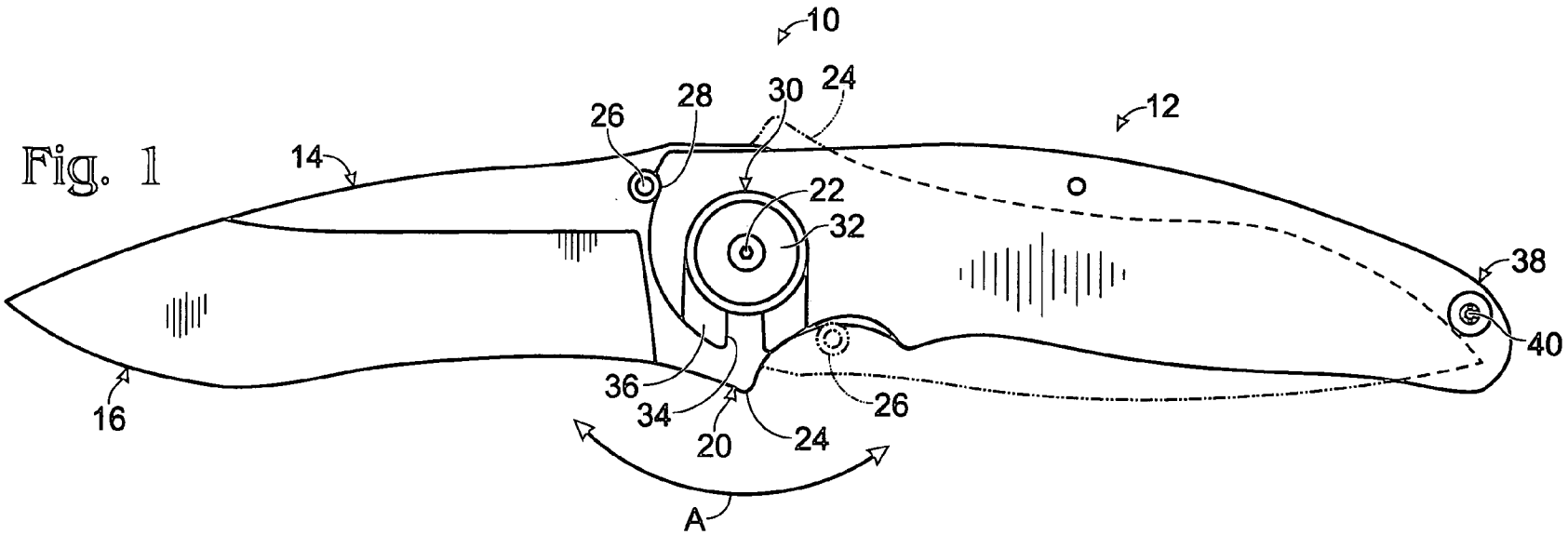
FIG. 1 is a side view of a folding knife according to an embodiment of the present disclosure.

Referring to the drawings, and more specifically to FIG. 1, a folding knife according to an embodiment of the present disclosure is shown generally at 10. Folding knife 10 includes a handle 12 and a blade 14. Distal end 16 of blade 14 typically includes a sharp point or tip 18, but may include a blunt end or other tool head. In some embodiments, the blade may be serrated or notched. Blade 14 is adapted to be folded or otherwise positioned in an open position, where the blade substantially extends from the handle 12 as shown in solid lines in FIG. 1 and a closed position where at least a portion of the blade is received within the handle as shown by the dashed lines in FIG. 1.

In the illustrated embodiment, blade 14 includes a tang 20 that is pivotally connected to handle 12 at a pivot point 22. Blade 14 is adapted to pivot about pivot point 22 between an open (fully-extended) position and a closed position as indicated by the arrow A. Although only an open fully-extended position and a closed position are illustrated, it should be appreciated that in some embodiments, the knife may be positioned in any number of various open and/or closed positions.

Blade 14 further includes a tang-protruding portion 24. Tang-protruding portion protrudes from handle 12 when the blade is in a closed position. Tang-protruding portion 24 is adapted to aid a user in opening blade 14 from the closed position. For example, a user may push protruding portion 24 into the handle, thereby urging blade 14 out of handle 12 into the open position. Blade 14 also includes a thumb stud 26 located on one or both sides of blade 14. Thumb stud 26 allows a user to apply a force to blade 14 further aiding in opening and/or closing of the blade. Such features are useful in one-handed assisted-opening devices and are further described in U.S. Pat. Nos. 6,145,202 and 5,802,722, the disclosures of which are incorporated by reference above.

It should be appreciated that the blade may be maintained in the open position by any suitable locking or retention mechanisms. For example, liner locks, sliding locks, spring locks, etc. may be used to retain the blade in a selected position. Additionally, the handle may include features which further operate to lock the blade in an open position. For example, in the embodiment shown, handle 12 includes an indentation 28 adapted to receive thumb stud 26 of blade 14 when the blade is in the open position. Indentation 28 acts as a stop for blade 14 preventing the blade from being moved or rotated beyond the fully-extended open position. Thus, in the open position, thumb stud 26 is cradled within indentation 28 of handle 12.

As described in more detail below, the handle 12 includes first and second side pieces 42, 44. A fastening device 30 disposed on the handle 12 is adapted to secure the first side piece 42 to the second side piece 44 and to secure the blade 14 to the handle 12. In some embodiments, including the embodiment shown in FIG. 1, fastening device 30 is disposed about pivot point 22 on the front end of handle 12. Regardless of location, fastening device 30 is adapted to be manually released by a user's hand.

As used herein, a manually-releasable fastening device or manipulable device includes a device that may be operated by using human force rather than mechanical force. Human force includes operation or control by skilled use of hands. For example, a manually-releasable fastening device may include a fastener adapted to be released without the use of machines or tools, such as, but not limited to, screwdrivers, wrenches, pliers, etc.

In the embodiment of FIG. 1, fastening device 30 is shown to include a knob 32. Knob 32 may be a manipulable switch, dial, collar, socket, or lever. Manipulation of knob 32 includes rotation of the knob by the hand of the user. Rotation effectively loosens or disengages the fastening device 30 from the handle, and consequently enables the blade to be released from the handle. Counter-rotation of knob 32 functions to secure the blade to the handle.

In the embodiment shown in FIG. 1, handle 12 is adapted to interact with fastening device 30. Handle 12 includes a receiving slot, also referred to herein as a handle slot 34, located on the handle. The receiving slot is adapted to engage a portion of the fastening device 30.

As described in more detail below, handle 12 further includes a rear connector 40 located at a rear end 38 of handle 12, where rear end 38 is distal to pivot point 22. The rear connector acts to secure components of the handle together. It should be noted that rear connector 40 may be capable of being selectively released to enable assembly/disassembly of handle 12.

Figure 2:
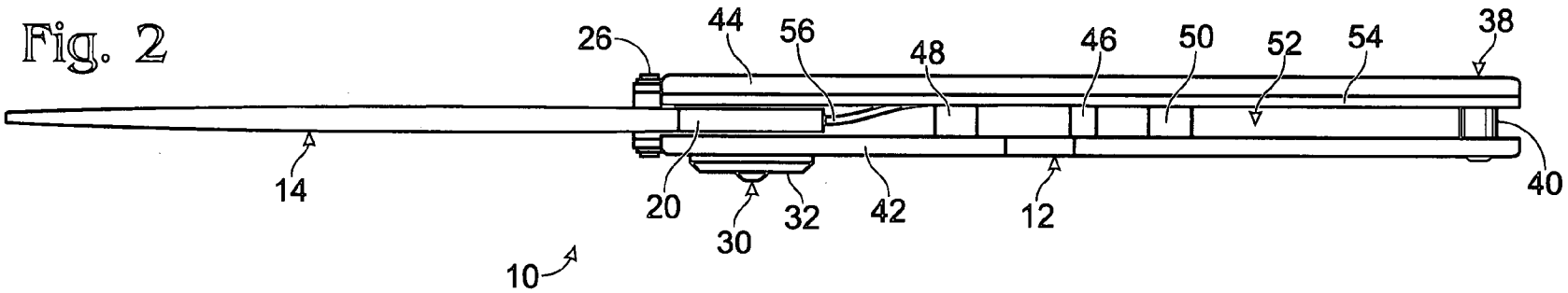
FIG. 2 is a top view of the folding knife of FIG. 1.

Referring to FIG. 2, handle 12, first side or first side piece 42 and second side or second side piece 44 are shown. The first side piece 42 is removably coupled to the second side piece 44. The side pieces 42, 44 are linked by a plurality of connectors and/or spacers. For example, the side pieces are spaced apart by a mid-anchor connector 46 and spacers 48 and 50, which may be attached to one or both sides of handle 12. The connectors/spacers define a hollow region or blade-receiving space 52 for receiving a portion of blade 14 when blade 14 is in a closed position relative to handle 12.

As briefly described above, first side piece 42 and second side piece 44 of handle 12 are additionally connected by a rear connector 40 substantially disposed toward the rear end 38 of handle 12. Rear connector 40 is shown to be a pin connector but may also be a bolt, a screw, a rivet, or any fastening device, and may be adapted to be released manually. It should be appreciated that other connectors may function in a similar manner as rear connector 40.

In the embodiment shown, a liner 54 is disposed beside the second side piece 44 such that the liner is positioned adjacent hollow region 52. Liner 54 includes a displaceable portion 56 that operates to lock blade 14 in an open position. The displaceable portion is biased such that the displaceable portion moves into the path of blade 14 once blade 14 has moved to a substantially-open position. The displaceable portion thus operates as a liner lock. Closing blade 14 includes disengaging or otherwise moving displaceable portion 56 of liner 54 out of the path of blade 14. Liner locks are well known in the art.

Figure 3:
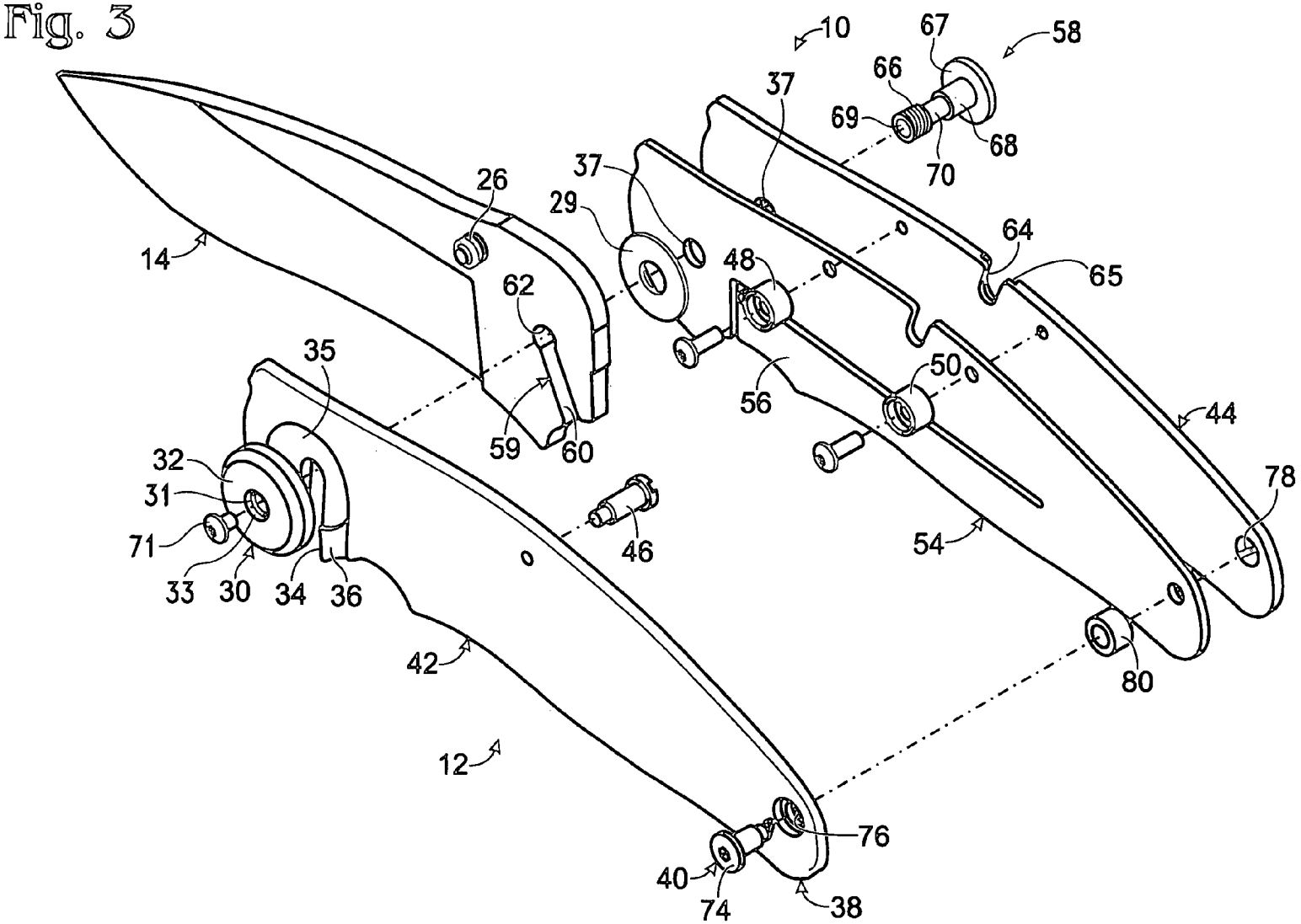
FIG. 3 is an exploded isometric view of the folding knife of FIG. 1 shown in the open position.

FIG. 3 further illustrates the components of knife 10. As described above, knife 10 includes a handle 12 including a plurality of connectors/spacers, such as mid-anchor connector 46, spacers 48, 50, rear connector 40, etc. The connectors/spacers may be any suitable pin, screw, bolt, etc. that operate to define a blade-receiving space or hollow region 52 linking the sides of the handle together. According to an embodiment of the invention, the spacers 48, 50 are affixed to the second side piece via respective fasteners such that, when the knife 10 is disassembled, the fasteners 48, 50 remain attached, and also serve to hold the liner 54 in position relative to the second side piece 44. Likewise, the mid-anchor connector 46 and the rear connector 40 are affixed to the first side piece 42 such that, when the knife 10 is disassembled, the mid-anchor connector 46 and the rear connector 40 remain attached to the first side piece 44.

As shown in FIG. 3, mid-anchor connector 46 is configured to couple with the mid-region of the handle side pieces 42, 44 together by fitting into a receiving cavity 64 within handle side piece 44 and engaging a shoulder 65 therein.

Figure 4:
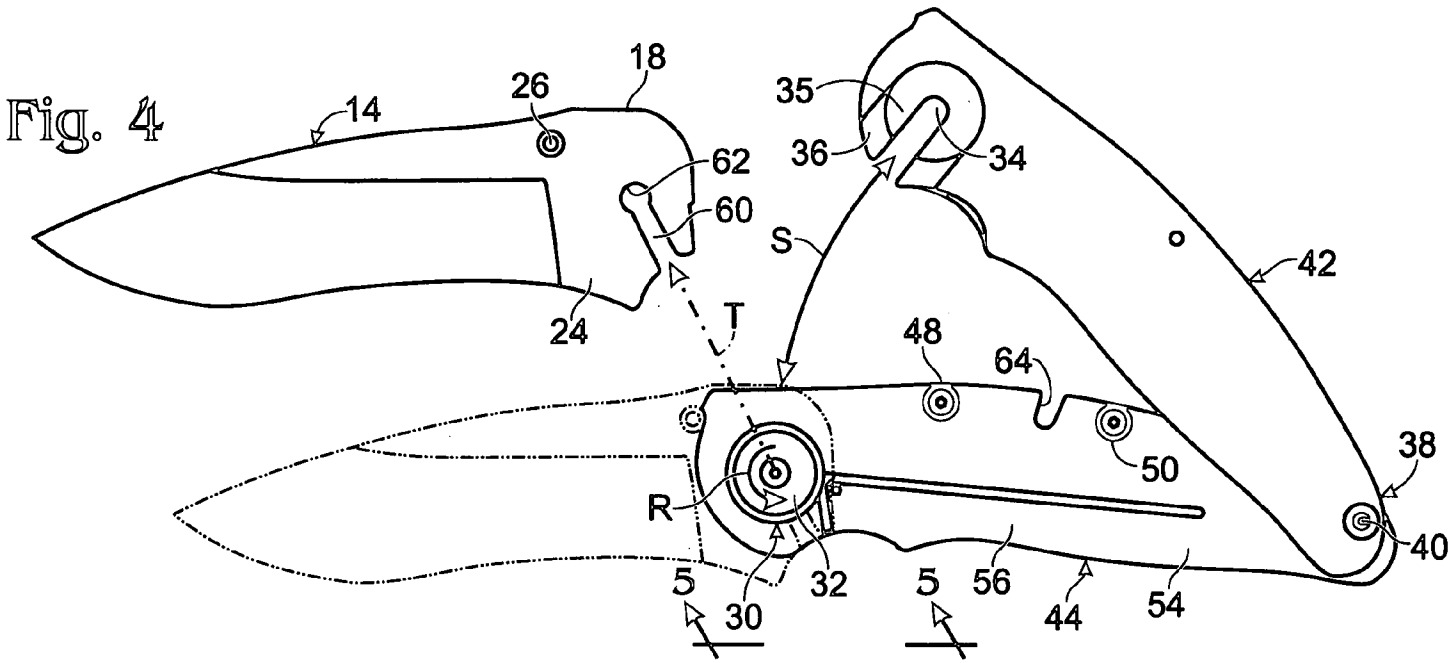
FIG. 4 is a side view of the folding knife of FIG. 1 showing partial disassembly of the knife.

The first side piece 42 includes a recessed seat 35 positioned concentric with the pivot point 22, and a channel 36 extending between the seat 35 and the edge of the side piece 42. The channel 36 is recessed to a first depth and the seat 35 is recessed to a second depth, greater than the first depth. The seat 35 is configured to receive the knob 32 as described hereafter. The slot 34 extends from the pivot point 22 to the edge of the knife, as shown in FIGS. 3 and 4. The second side piece 44 and the liner 54 each include an aperture 37 positioned concentric with pivot point 22.

Fastening device 30 includes the knob 32 coupled with a retention pin or post 58. Retention post 58 includes a head 67, a pivot collar 68, a pivot neck 70, a threaded collar 66, and a threaded retention aperture 69. The retention post is press fit or otherwise fixed in the aperture 37 of the second side piece 44. Knob 32 includes a knob recess 33 penetrating from a first side of the knob a portion of the thickness of the knob 32, and a threaded aperture 31 between the knob recess 33 and a second side of the knob 33. The threaded aperture 31 is adapted to engage the threaded collar 66 of retention post 58. A threaded limiting fastener 71 is configured to engage the retention aperture 69 of the retention post 58 and serve to prevent the knob 32 from being fully removed from the post 58 when loosened.

A back washer 29 is shown positioned on the retention post 58 between the blade 14 and the liner 54. While not shown, a front washer may also be included, positioned between the blade 14 and the first side piece 42.

In the disclosed embodiment, the retention post 58 is received in the apertures 37 such that it extends toward the first side piece 42. Blade 14 includes an inlet 59, which includes a blade slot 60 and a pivot aperture 62. Inlet 59 is adapted to engage retention post 58 via blade slot 60 in the tang of the blade. Blade slot 60 terminates in the pivot aperture 62 which is adapted to be seated around pivot collar 68 as described in more detail below. Blade 14 pivots about retention post 58 between an open and a closed position. Retention post 58 further functions to couple handle side pieces 42 and 44 together. Retention post 58 extends through apertures 37 of the second side piece 44 and liner 54, pivot aperture 62 of the blade 14, and slot 34 of the first side piece 42.

Figure 5:
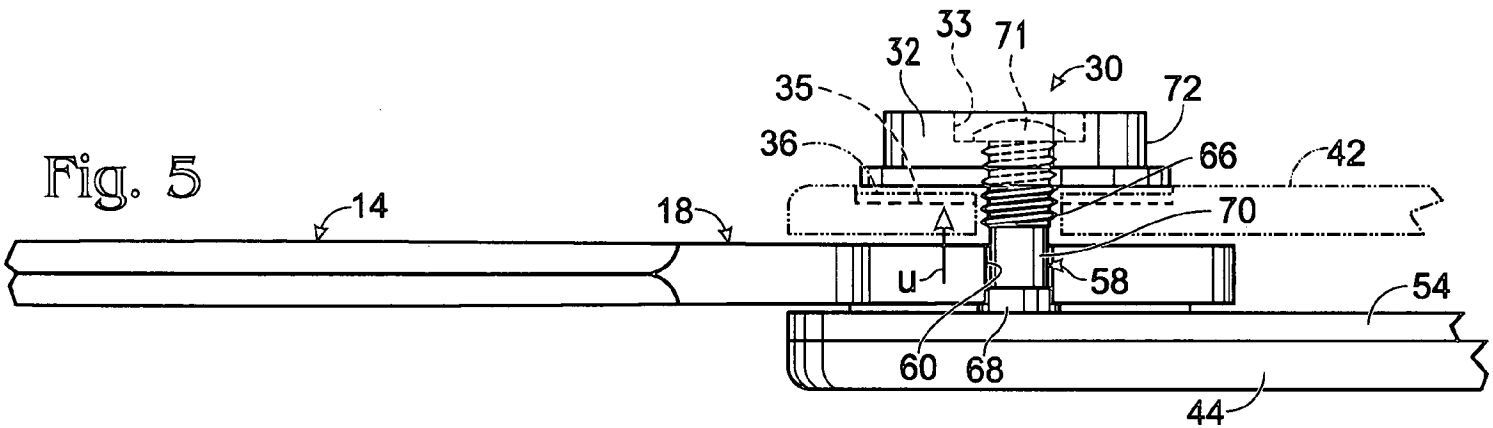
FIG. 5 is an enlarged fragmentary bottom view of a portion taken along line 5-5 of the folding knife shown in FIG. 4.

FIGS. 4 and 5 illustrate a method of manual assembly/disassembly of blade 14 from handle 12. The handle pieces and blade are in an engaged position when they are secured in an operable fashion by the fastening device 30. In the embodiment shown, release of fastening device 30 is achieved by turning knob 32 in a counter-clockwise direction, as indicated by arrow R. The knob 32 is movable between an engaged position in which the knob bears against the recessed seat 35, and a disengaged position in which an inner surface of the knob recess 33 bears against the limiting fastener 71. Rotation of knob 32 in the counter-clockwise direction enables knob 32 to rise upwards on the threaded collar 66 of post 58 and move to the disengaged position from recessed seat 35.

It should be noted the while the direction indicated for rotation of knob 32 is in the counter-clockwise direction, it is possible that device 30 may alternatively be released from the engaged position by clockwise rotation of knob 32. Moreover, other mechanisms for releasing knob 32 may be used without departing from the scope of the invention.

When the knob 32 rises on the post 58 a distance exceeding a difference between the depth of the recessed seat 35 and the depth of the channel, the first side 42 of the handle is able to be rotated or pivoted away from the fastening device 30 as the retention post 58 passes through the handle slot 34. Rotation of handle side 42 away from handle side 44 is illustrated by arrow S in FIG. 4.

After rotation of handle side 42 from handle side 44, the blade may be disengaged from the fastening device. As described in more detail in relationship to FIG. 5, the blade may be slid off of or otherwise disconnected from retention post 58 of fastening device 30. Removal of blade 14 from fastening device 30 is indicated by dashed arrow T.

Referring to FIG. 5, the circumference of pivot collar 68 is greater than the circumference of pivot neck 70. Pivot aperture 62 of blade 14 is sized to receive pivot collar 68. When pivot collar 68 is received within pivot aperture 62, and clamped between the side pieces 42, 44 of the handle 12 via fastening mechanism 30, blade 14 is unable to slide off of post 58 because blade slot 60 is sized to prevent pivot collar 68 from passing through slot 60.

Removal of blade 14 from retention post 58 includes moving blade 14 upward in direction of arrow U and onto the comparatively narrower neck 70 of retention post 58. Although blade slot 60 is too narrow to allow base 68 to pass through, blade slot 60 is sized such that neck 70 may pass through. Thus, upward movement of blade 14 aligns slot 60 with neck 70 such that the blade may be slid off of neck 70 and removed from retention post 58. This can only occur when the first side piece 42 has been rotated away from the retention post 58.

FIG. 5 further illustrates friction grips 72 adapted to assist a user in the release of the fastening device. For example, the friction grips may enable a user to more easily turn knob 32 by hand without the use of any tools.

It should be noted that in some embodiments the handle side pieces 42, 44 may be assembled and disassembled manually. For example, and as discussed above, the side pieces of the handle may be coupled via a rear connector 40. Referring back to FIG. 3, rear connector 40 is shown to include a pin 74 which extends through a receiving aperture 76 in the first side piece 42 handle, through the rear spacer 80, and an aperture in liner 54 to a pin slot 78 on the second side piece 44.

Figure 6:
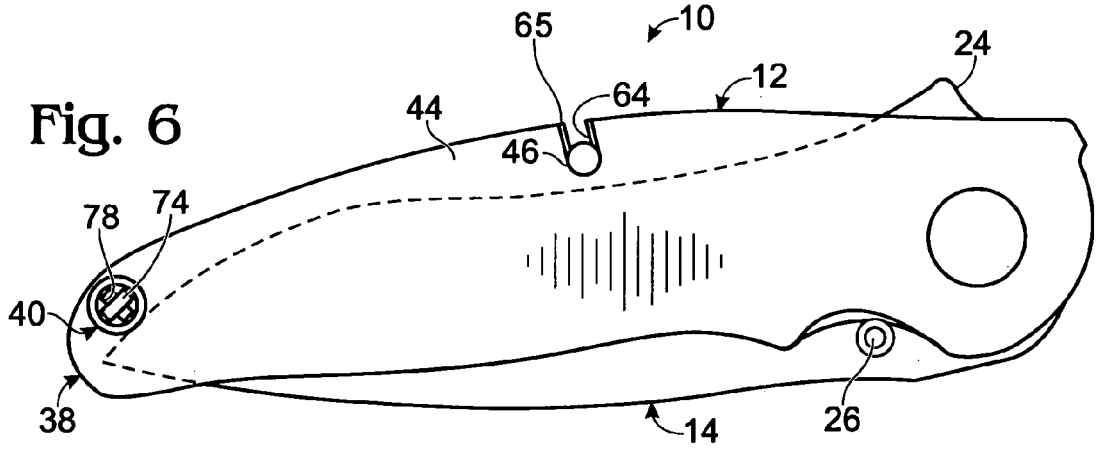
FIG. 6 is a side view of the folding knife of FIG. 1 with the blade in a closed position.
Figure 7:
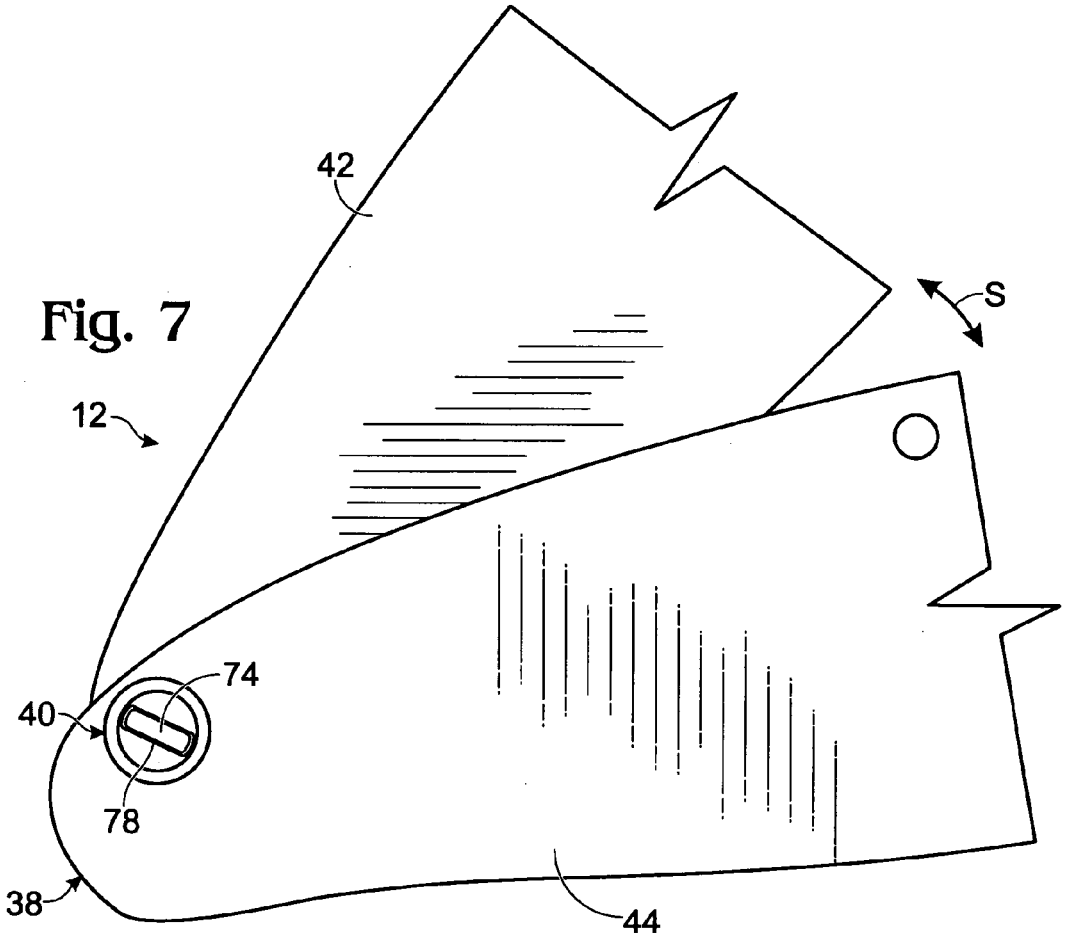
FIG. 7 is an enlarged fragmentary isometric view of the opposing side of the folding knife of FIG. 4.

FIG. 6 illustrates the position of the pin relative the pin slot when the knife is assembled. Specifically, pin 74 extends substantially transverse to or otherwise off set from the pin slot 78 such that the first and second side handles are secured together. FIG. 7 illustrates a method of manually disengaging the first side piece 42 from the second side piece 44. Specifically, first side piece 42 is rotated relative to second side piece 44. In the rotated position, pin 74 aligns with pin slot 78 such that pin 74 may pass through pin slot 78, thus enabling the separation of the first side piece from the second side piece.

FIG. 6 also illustrates mid-anchor 46 positioned within receiving cavity 64 and engaging shoulder 65. It should be appreciated that the receiving cavity 64 is shaped to enable the rotation of the first side piece and mid-anchor 46 out of receiving cavity 64.

Assembly of the knife generally follows the reverse of the disassembly method described above: the first and second side pieces 42, 44 are aligned in the rotated position shown in FIG. 7. such that the pin 74 may be inserted into pin slot 78, after which the first side piece 42 is rotated toward engagement with the fastening device 30, thereby securing the side pieces 42, 44 together.

The blade is attached to the handle 12 by sliding the blade slot 60 over the neck 70 of retention post 58. Pivot aperture 62 of blade 14 is then seated onto the pivot collar 68 of retention post 58. As the first and second side pieces 42, 44 are rotated toward parallel alignment, as shown in FIG. 4, retention post 58 is received within handle slot 34 of side piece 42. Knob 32 is moved from the disengaged to the engaged position on retention post 58 and bearing against the seat 35 thereby securing first and second side pieces in parallel alignment, and the knife blade 14 to the handle 12. It should be appreciated that rotation of the handle pieces into alignment causes pin 74 to rotate perpendicular to pin slot 78, thus preventing the disengagement of handle side pieces from each other.

It will be appreciated that the knife 10 of the disclosed embodiment has several advantages over conventional folding knives: It can be disassembled without the use of tools; disassembly and reassembly is uncomplicated and straightforward; and when disassembled, there are no small parts that become separated from the knife 10, inasmuch as all fasteners, washers, and spacers, are affixed to one or the other of the side pieces 42, 44 or held by the retention post 58, with the knob 32 being retained by the pivot fastener 71. These advantages make the knife 10 ideal for use in harsh environments or under conditions where it becomes necessary to service the knife in the field. For example, a user might find it necessary to disassemble the knife 10 to be thoroughly cleaned at a stream-side or in a camp. A convention knife would present difficulties, first, in disassembly without tools, and, second, in the likelihood of lost parts.

In describing disassembly of the knife 10, above, a description of a field disassembly is provided. It will be recognized that a complete disassembly would include the separation of fasteners, spacers, washers, etc., from the larger components, which can be accomplished with the appropriate tools.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A knife comprising:

a handle having first and second side pieces coupled in a spaced-apart relationship and rotatable, relative to each other, around a first pivot axis between an open and a closed position;

a blade coupled to the handle, the blade being rotatable, while the first and second said pieces of the handle are in the closed position, around a second pivot axis, relative to the handle, between an extended position and a folded position, and configured to be removable from the handle only while the first and second side pieces are rotated away from the closed position; and a fastener coupled to the second side piece and movable between an engaged position to rotationally lock the first and second side pieces in the closed position, such that the fastener exerts a clamping force on the first side piece for preventing the first side piece from rotating relative to the second side piece and a disengaged position to release the first side piece for rotation away from the closed position, with the fastener remaining coupled to the second side piece.

2. The knife of claim 1 wherein the fastener comprises a post having a pivot neck of a first diameter and a pivot collar of a second diameter, greater than the first diameter, and wherein the blade includes a pivot aperture having a diameter greater than the second diameter and a slot extending from the pivot aperture to an edge of the blade, the slot having a width greater than the first diameter but less than the second diameter.

3. The knife of claim 2 wherein, while the first and second side pieces are in the closed position the blade is held such that a portion of the pivot collar is within the pivot aperture, and while the first and second side pieces are rotated away from the closed position, the blade is translatable to a position in which only the pivot neck is within the pivot aperture, such that the blade can be removed from the handle by passing the pivot neck through the slot of the blade.

4. The knife of claim 1 wherein the fastener comprises a post having a threaded collar, a threaded aperture, a knob threadedly received on the threaded collar of the post, and a retention fastener threadedly received in the threaded aperture and configured to prevent complete removal of the knob from the post.

5. The knife of claim 1 wherein:

the fastener comprises a post having a threaded collar, a threaded aperture, and a knob threadedly received on the threaded collar of the post, the first side piece includes a handle slot extending from the second pivot axis to an edge of the first side piece, a seat centered on the second pivot axis and recessed to a first depth, and a channel centered over the slot and extending from the seat to the edge of the first side piece, the slot being recessed to a second depth less than the first depth; and the knob is configured to move between an engaged position, wherein the knob bears against the seat, and a disengaged position, where the knob at least clears the channel such that the first side piece can be rotated away from the closed position, the post passing through the handle slot.

6. The knife of claim 1, comprising a connector element positioned at the first axis and coupled to one of the first and second side pieces and configured such that, while the first and second side pieces are in the open position relative to each other, the first and second side pieces are separable from each other, and, while the first and second side pieces are not in the open position relative to each other, they are not separable.

7. A knife comprising:

a handle including a first side piece and a second side piece, the first side piece removably fastened to the second side piece;

a blade removably secured to the handle where the blade is rotatable about a pivot point between an open position in which the blade extends away from the handle and a closed position in which the blade is at least partially received within the handle; and a manipulable fastening device, movable between an engaged position, in which the first side piece is and locked to the second side piece by means of a clamping force asserted on the first piece for preventing the first side piece from rotating relative to the second side piece and the blade is secured to the handle and rotatable between the open and closed positions, and a disengaged position, in which the blade is separable from the handle and the first side piece is rotatable with respect to the second side piece, the fastening device being disposed on the handle in a position that substantially corresponds to the pivot point, the fastening device being configured to removably secure the blade to the handle and removably secure the first side piece to the second side piece while remaining coupled to the second side piece.

8. The knife of claim 7 wherein the blade has a tang including a slot adapted to engage and secure a retention post of the fastening device.

9. The knife of claim 8 wherein the blade includes a retention aperture having a diameter greater than a width of the slot, configured to engage a pivot collar of the manipulable fastening device.

10. The knife of claim 7 wherein the first side piece includes a recessed seat against which a knob of the manipulable fastening device is configured to bear.

11. The knife of claim 10 wherein the first side piece includes a slot extending from an edge of the first side piece to the recessed seat and positioned to admit passage of a portion of the manipulable fastening device while the manipulable fastening device is in the disengaged position.

12. The knife of claim 7 wherein rotation of the first side piece to a selected position relative to the second side piece enables separation of the first side piece from the second side piece.

13. The knife of claim 7 wherein the manipulable fastening device is manipulable by human force, without the use of tools.

* * * * *

UNITED STATES PATENT AND TRADEMARK OFFICE

CERTIFICATE OF CORRECTION

PATENT NO. : 7,716,839 B2
APPLICATION NO. : 11/195330
DATED : May 18, 2010
INVENTOR(S) : Kenneth J. Onion et al.

It is certified that error appears in the above-identified patent and that said Letters Patent is hereby corrected as shown below:

Title Page, Item 73, Assignee,
"KAI U.S.A., Ltd., Tualatin, OR (US)" should read, --KAI U.S.A., Ltd., dba Kershaw Knives, Tualatin, OR (US)--.

Column 8, Lines 15-19
"a blade removavly secured to the handle where the blade is rotatable about a pivot point between an open position in which the blade extends away from the handle and a closed position in which the blade is at least partially received within the hand; and" should read, --a blade removably secured to the handle, the blade being rotatable, which secured to the handle, about a pivot point between an open position in which the blade extends away from the handle and a closed position in which the blade is at least partially received within the handle; and--.

Column 8, Line 21
"engaged position, in which the first side piece is and" should read, --engaged position, in which the first side piece is secured and--.

Signed and Sealed this
Twenty-fourth Day of May, 2011

David J. Kappos

David J. Kappos
*Director of the United States Patent and Trademark Office*